US005991421A

United States Patent [19]

Faraone

[11] Patent Number: 5,991,421

[45] Date of Patent: Nov. 23, 1999

[54] RADIALLY EXPANDING MULTIPLE FLAT-SURFACED WAVEGUIDE DEVICE

[75] Inventor: Alexander Faraone, Frenchtown, N.J.

[73] Assignee: Single Source Technology and Development, Inc., Maple Shade, N.J.

[21] Appl. No.: 08/966,639

[22] Filed: Nov. 10, 1997

[51] Int. Cl.[6] ..... H04R 1/02; H04R 25/00

[52] U.S. Cl. ..... 381/338; 381/337; 381/339; 381/340; 181/159; 181/177; 181/192

[58] Field of Search ..... 381/337, 338, 381/339, 340, 350; 181/152, 159, 172, 192

[56] References Cited

U.S. PATENT DOCUMENTS

| | | | |
|---|---|---|---|
| 2,513,171 | 6/1950 | Hassan | 381/337 |
| 2,923,782 | 2/1960 | Armstrong et al. | 381/337 |
| 4,811,403 | 3/1989 | Henricksen . | |
| 5,606,297 | 2/1997 | Phillips | 381/339 |

*Primary Examiner*—Curtis A. Kuntz
*Assistant Examiner*—Dionne N. Harvey
*Attorney, Agent, or Firm*—Kenneth P. Glynn, Esq.

[57] ABSTRACT

The present invention is a waveguide for an acoustic speaker having a predetermined cone weight. The waveguide body has a speaker end and an open end and an even number of segments with a flat surface in a plane parallel to the speaker end. The segments have inside wall surfaces which flare increasingly outwardly from the speaker, and these inside wall surfaces have a speaker end length, $L_1$, determined by the following formulas, $L_1$ minimum=$0.7\times w_s/0.0012$ g/cm$^3$ $\times 1/A_{SE}$, and $L_1$ maximum=$1.2\times w_s/0.0012$ g/cm$^3$ $\times 1/A_{SE}$, wherein $L_1$ is a straight line length of the lower portion of the segment wall surface, $w_s$ is the weight of a speaker cone in grams/cm$^3$, and $A_{SE}$ is the cross-sectional area of the speaker end in square centimeters. Each of the segment inside wall surfaces has an outer end length $L_2$ which has a predetermined length related to $L_1$. There is an angle between the straight line length of the lower portion of the segment wall surface and a center line running down the center of the length of the waveguide, referred to as ∠A, which is no greater than 15°.

14 Claims, 3 Drawing Sheets

RADIALLY EXPANDING MULTIPLE FLAT-SURFACED WAVEGUIDE DEVICE

BACKGROUND OF THE INVENTION

1. Field of the Invention

The present invention relates to waveguides and more particularly unique waveguide configurations utilizing a plurality of an even number of flat-surfaced segments which have unique geometric characteristics and may be constructed of light weight materials.

2. Information Disclosure Statement

Loudspeakers are well known and take the form of cones or horns. Conical loudspeakers have circular open ends and horns typically have rounded or straight edges such as rectangular open ends. U.S. Pat. No. 4,811,403 illustrates various types of horns for ultralight loudspeakers. This patent describes a loudspeaker and enclosure assembly which includes a load bearing member exhibiting good thermal conductivity; at least one loudspeaker mounted on the load bearing member and in thermal engagement therewith; and its enclosure having walls formed of rigid lightweight material mounted on the load bearing member to enclose the at least one loudspeaker, whereby the assembly is easily moved and mounted and thermal energy generated by operation of the loudspeaker is effectively dissipated through the load bearing member. The enclosure may be a rigid foam-filled member defining a generally funnel-shaped bore therein to form a horn for the loudspeaker, whereby a modular construction of interchangeable integrally formed enclosures and horns can be achieved. However, this patent does not show the type of arrangement or assembly specifically claimed herein.

Notwithstanding the prior art, the present invention is neither taught nor rendered obvious thereby.

SUMMARY OF THE INVENTION

The present invention is a waveguide for an acoustic speaker having a predetermined cone weight. It has a waveguide body having a speaker end and an open end and having a plurality of segments. The segments are substantially similar to one another, preferably identical, there being an even number of segments from four to twenty. Each of the segments have a flat surface in a plane parallel to the speaker end. Each of the segments having inside wall surfaces which flare increasingly outwardly from the speaker, and wherein each of the segments' inside wall surfaces has a speaker end length, $L_1$, which is within the range determined by the following formulas:

$$L_1 \text{ minimum}=0.7\times w_s/0.0012 \text{ g/cm}^3\times 1/A_{SE}$$

and $$L_1 \text{ maximum}=1.2\times w_s/0.0012 \text{ g/cm}^3\times 1/A_{SE}$$

wherein $L_1$ is a straight line length of the lower portion of the segment wall surface, referred to as the speaker end length, $w_s$ is the weight of a speaker cone in grams/cm$^3$, and $A_{SE}$ is the cross-sectional area of the speaker end in square centimeters. Each of the segment inside wall surfaces has an outer end length $L_2$ wherein $L_2$ has a length within the range determined by the following formulas:

$$L_2 \text{ minimum}=0.7\times L_1$$

and $$L_2 \text{ maximum}=1.3\times L_1.$$

There is an angle between the straight line length of the lower portion of the segment wall surface and a center line running down the center of the length of the waveguide, referred to as ∠A, which is no greater than 15°. There is also a straight line length of the entire segment wall forming an angle with a center line running down the center of the length of the waveguide, referred to as ∠B, which is within the range determined by the following formulas:

$$\angle B \text{ minimum}=1.5\times\angle A$$

and $$\angle B \text{ maximum}=2.5\times\angle A.$$

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
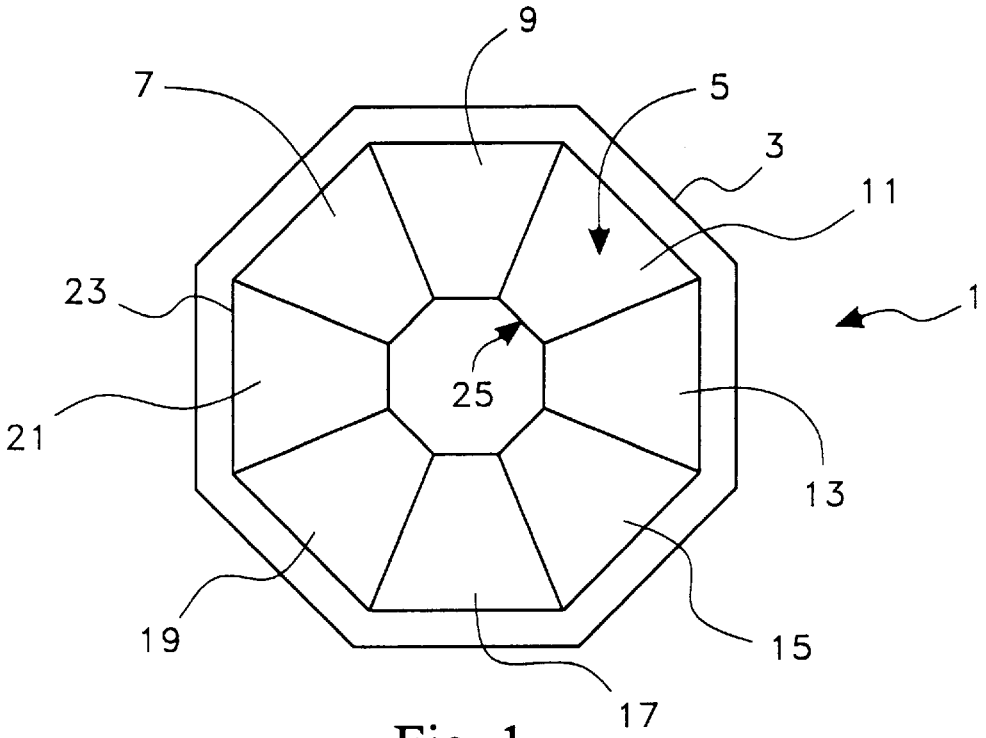
FIG. 1 shows a front view of one preferred embodiment waveguide of the present invention and FIG. 2 shows a side cut view thereof.

As mentioned above, the waveguide of the present invention has unique geometric characteristics. It is a full range waveguide which may be used with circular or other speaker cones is particularly effective with speaker cones and having arcuated segments as described in U.S. Pat. No. 4,881,617 to the inventor herein dated Nov. 21, 1989.

The present invention waveguide has an even number of segments with inside wall surfaces which are flat. By "flat" is meant that each inside wall of the segments has one dimension which is linear. These segments flare outwardly as to width and bend outwardly relative to a central axis along the center of the length of the waveguide. There are at least four segments. Preferably there are four to twenty segments to each waveguide and more preferably eight to eighteen segments. The segment inside walls, and the waveguide itself has a speaker end, that is, the end where the speaker's attached and an open end, the end furthest away from the speaker attachment location.

The present invention waveguide may be viewed as having an overall length which can be divided into two length portions, a lower length which is closer to the speaker end and hereinafter referred to as the "speaker end length" and an outer length which begins at the end of the speaker end length and terminates at the open end, hereinafter referred to as the "open end length". The speaker end length, $L_1$ is measured as a straight line by connecting the beginning point of a segment inside wall to a predetermined point in the arcing wall as viewed from a side view. The open end length, $L_2$, is a straight line measurement taken from the end of the speaker end length to the top or open end of the waveguide. The overall length, $L_3$, is the straight line length measured from the speaker end to the open end. All of these lengths are measured from a side view of a segment.

In the present invention waveguides, the speaker end length of each segment is based in part on the weight of a speaker cone, $w_s$, to be employed as well as the cross-sectional area of the speaker end of the waveguide itself, $A_{SE}$. Thus, the minimum speaker end length is 0.7 times the speaker weight divided by the mass of air (0.0012 grams per cubic centimeters) times one over the cross-sectional area of the speaker end. The maximum speaker end length is utilizing the same formula but instead of 0.7 as the multiplier, 1.2 is the multiplier. In preferred embodiments, the maximum multiplier is 1.0.

The open length is within the range of 0.7 to 1.3 times the speaker end length. It is typically about equal to the speaker end length but shorter or longer lengths may be used without exceeding the scope of the present invention. In any event, $L_2$ should be at least half of the length of $L_1$ or greater.

There is an angle between the straight line length of the lower portion of the segment wall surface and a center line running down the center of the length of the waveguide, referred to as ∠A, which is no greater than 15°. There is also a straight line length of the entire segment wall forming an angle with a center line running down the center of the length of the waveguide, referred to as ∠B, which is within the range determined by the following formulas, ∠B minimum=1.5 ×∠A and ∠B maximum=2.5×∠A. Typically, angle A is no greater than 12° and angle B is about 1.8 to 2.2 times angle A. In most preferred embodiments angle B is approximately twice angle A.

Figure 2:
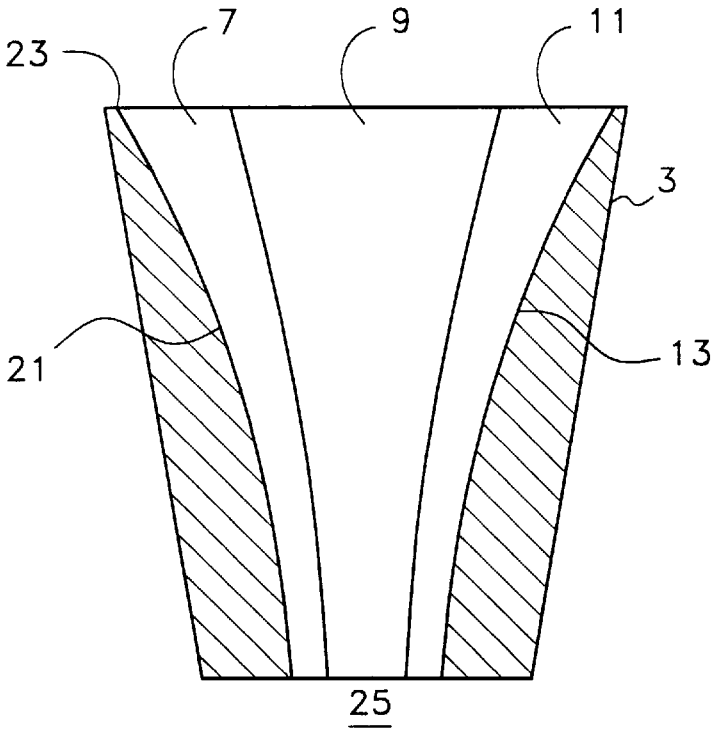

FIG. 1 shows a front view and FIG. 2 shows a side cut view of one preferred embodiment waveguide device of the present invention. Identical parts identically numbered.

FIG. 1 shows waveguide 1 having an outside octagonal wall 3. The exact configuration of octagonal wall 3 is not critical to the present invention. What is critical, is the shape of the inside wall 5, hereinafter referred to as segments, there are eight segments, namely, segments 7, 9, 11, 13, 15, 17, 19 and 21. There is a top open end 23 and a bottom speaker end 25. Hereinafter these will be referred to as the open end and the speaker end respectively.

As shown in FIG. 2 the side cut view of waveguide 1 of FIG. 1 shows that the speaker end has a much smaller opening than the open end, that the segments flare outwardly from speaker end to open end and thereby increase in width from speaker end to open end.

Figure 3:
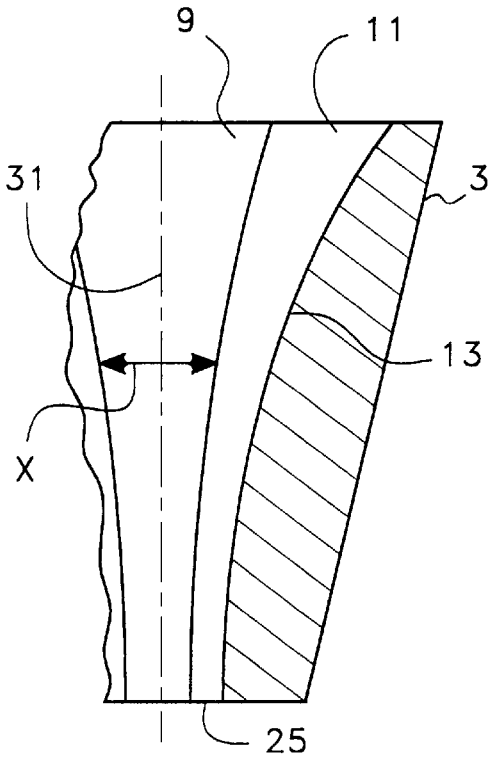
FIG. 3 illustrates a partial cut side view of FIG. 2 with critical parameters illustrated and FIG. 4 shows a side cut view of a segment of the present invention waveguide shown in the previous figures.

FIG. 3 shows a partial repeat view of FIG. 2 with identical parts identically numbered but illustrates a central axis 31 about which all of the waveguide segments are symmetrically related to one another, i.e. opposite segments are mirror images of one another. With line x is shown to further illustrate the increasing width of each segment, such as segment 9 and to also illustrate that if line x were taken parallel to the speaker end anywhere along segment 9, it would be a flat line.

Figure 4:
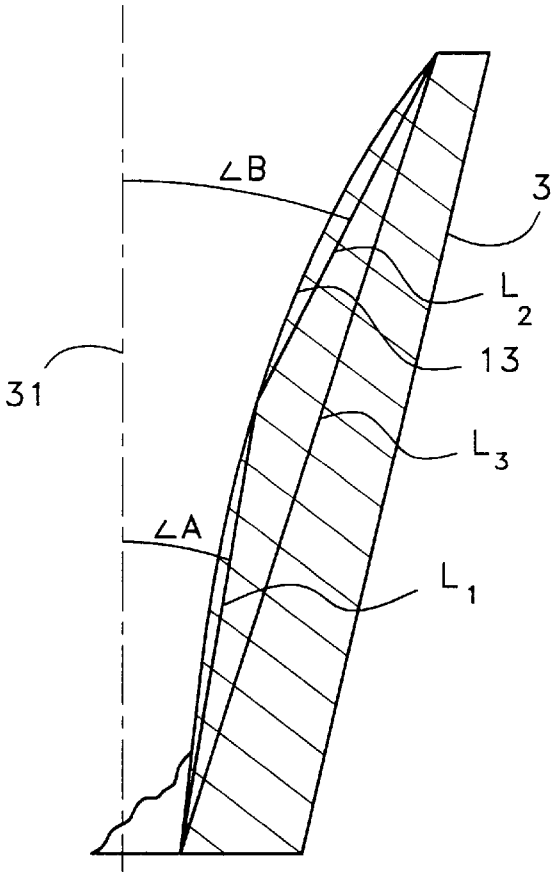

FIG. 4 shows cut side view segment 13 and illustrates ∠A and ∠B relative to center line 31 (these angles are defined in more detail above). Speaker end length $L_1$, is illustrated in conjunction with ∠A and relative to segment 13 inside wall, as is open end length $L_2$ and ∠B. Overall straight line length $L_3$ is also illustrated.

Figure 5:
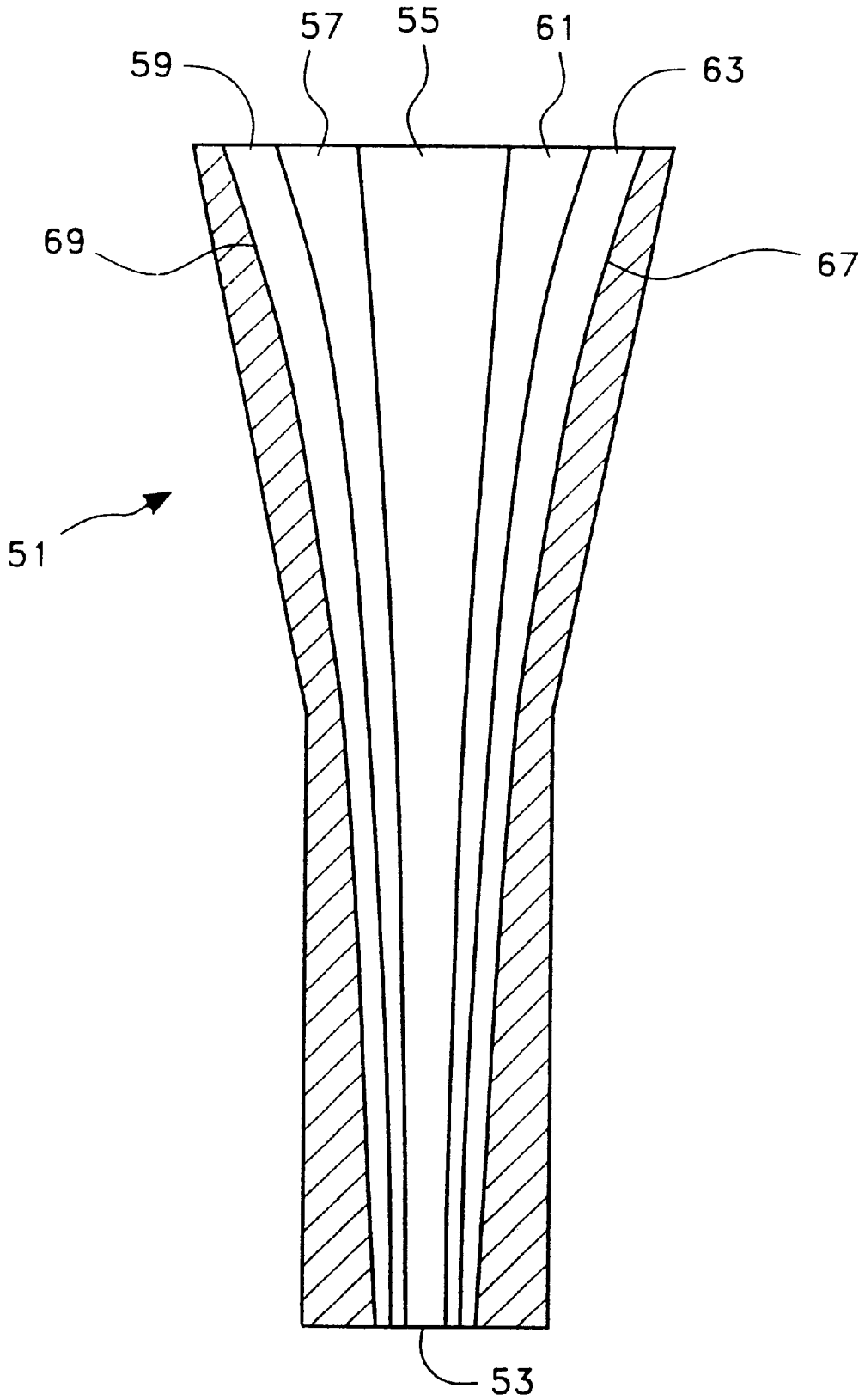
FIG. 5 shows a cut side view of an alternative waveguide device of the present invention.

FIG. 5 shows a side cut view of another present invention waveguide 51 which has a much longer overall length and narrower angles but conforms to the formula set forth above. Waveguide 51 has a total of twelve segments and in this case because it is shown in a cut sectional view, it illustrates five whole segments, such as segments 55, 57, 59, 61 and 63 plus two half segments in their side view, segments 67 and 69. This waveguide may be formed of foam and have a skinned surface similar to the construction described above and will receive an acoustical speaker at speaker end 53. One embodiment of the specific characteristics of a waveguide shown in FIG. 5 is discussed below in detail in conjunction with Example 3.

EXAMPLE 1

A 40°×40° waveguide of the present invention contains eight equal segments such as is illustrated in FIGS. 1 through 4. The overall length of the speaker as measured in a straight line is approximately 26 inches. The speaker end has a cross-sectional opening of 6.8 inches and the speaker end length, $L_1$, is approximately 13.5 inches and has an angle ∠A of 10°. The open end length, $L_2$, is approximately 14 inches and has an angle ∠B of 20°. The open end has a cross-sectional opening of about 21.5 inches. The total speaker straight line length is approximately 25.7 inches. This 40°×40° waveguide (40° total angle of opening at open end taking two measurements at right angles to one another) is constructed of polyurethane foam with a urethane skin coating. Attached to a speaker of the U.S. Pat. No. 4,881,617, Faraone speaker, with arcuated segments, the waveguide provides excellent full range projection with minimal distortion.

EXAMPLE 2

A 40°×40° cone is constructed in accordance with Example 1 but utilizing sixteen segments instead of eight. The waveguide is constructed of foam with integral skin and includes mounting brackets embedded therein for speaker support and attachment.

EXAMPLE 3

Another, elongated, present invention waveguide of the type set forth in FIG. 5, is constructed with twelve segments and has a total length of about 27 inches. Its speaker end has a cross-sectional opening of 2.8 inches and an open end cross-sectional opening of about 9 inches. ∠A is 5° and ∠B is 12°. The open end thus has a 24°×24° opening. This waveguide has no angle change for the lower half of the $L_1$ portion of each segment, and then the angle increases from 0° to 5° over the remaining length of that $L_1$ portion of each segment. Thus, about ¼ of the total length of the waveguide toward its speaker end is of constant cross-section.

Obviously, numerous modifications and variations of the present invention are possible in light of the above teachings. It is therefore understood that within the scope of the appended claims, the invention may be practiced otherwise than as specifically described herein.

What is claimed is:

1. A waveguide for an acoustic speaker having a predetermined cone weight, which comprises:

a waveguide body having a speaker end and an open end and having a plurality of segments, said segments being substantially similar to one another, there being an even number of segments from four to twenty each of said segments having a flat surface in a plane parallel to said speaker end, each of said segments having inside wall surfaces which flare increasingly outwardly from said speaker, and wherein each of said segments' inside wall surfaces has a speaker end length, $L_1$, which is within the range determined by the following formulas:

$$L_1 \text{ minimum}=0.7\times w_s/0.0012 \text{ g/cm}^3\times 1/A_{SE}$$

and $$L_1 \text{ maximum}=1.2\times w_s/0.0012 \text{ g/cm}^3\times 1/A_{SE}$$

wherein $L_1$ is a straight line length of the lower portion of the segment wall surface, referred to as the speaker end length, $w_s$ is the weight of a speaker cone in grams/cm$^3$, and $A_{SE}$ is the cross-sectional area of the speaker end in square centimeters;

further wherein each of said segment inside wall surfaces have an outer length $L_2$ which is at least 0.5 times $L_1$;

further wherein the angle between the straight line length of the lower portion of the segment wall surface and a center line running down the center of the length of the waveguide, referred to as ∠A is no greater than 15° and wherein the straight line length of the entire segment wall and a center line running down the center of the length of the waveguide referred to as ∠B is within the range determined by the following formulas:

$$\angle B \text{ minimum}=1.5\times\angle A$$

and $$\angle B \text{ maximum}=2.5\times\angle A.$$

2. The waveguide of claim 1 wherein there are between eight and eighteen segments forming said waveguide.

3. The waveguide of claim 1 wherein $L_2$ has a length within the range determined by the following formulas:

$$L_2 \text{ minimum}=0.7\times L_1$$

and $$L_2 \text{ maximum}=1.3\times L_1.$$

4. The waveguide of claim 2 wherein $L_2$ has a length within the range determined by the following formulas:

$$L_2 \text{ minimum}=0.7\times L_1$$

and $$L_2 \text{ maximum}=1.3\times L_1.$$

5. The waveguide of claim 1 wherein said ∠A is no greater than 12°.

6. The waveguide of claim 1 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

7. The waveguide of claim 2 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

8. The waveguide of claim 3 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

9. The waveguide of claim 5 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

10. The waveguide of claim 1 wherein said ∠B is within the range determined by the formulas:

$$\angle B \text{ minimum}=1.8\times\angle A$$

and $$\angle B \text{ maximum}=2.2\times\angle A.$$

11. The waveguide of claim 2 wherein said ∠B is within the range determined by the formulas:

$$\angle B \text{ minimum}=1.8\times\angle A$$

and $$\angle B \text{ maximum}=2.2\times\angle A.$$

12. The waveguide of claim 3 wherein said ∠B is within the range determined by the formulas:

$$\angle B \text{ minimum}=1.8\times\angle A$$

and $$\angle B \text{ maximum}=2.2\times\angle A.$$

13. The waveguide of claim 5 wherein said ∠B is within the range determined by the formulas:

$$\angle B \text{ minimum}=1.8\times\angle A$$

and $$\angle B \text{ maximum}=2.2\times\angle A.$$

14. The waveguide of claim 6 wherein said ∠B is within the range determined by the formulas:

$$\angle B \text{ minimum}=1.8\times\angle A$$

and $$\angle B \text{ maximum}=2.2\times\angle A.$$

* * * * *